US008221951B2

(12) United States Patent
Zhou et al.

(10) Patent No.: US 8,221,951 B2
(45) **Date of Patent: *Jul. 17, 2012**

(54) TONER COMPOSITIONS AND METHODS

(75) Inventors: Ke Zhou, Oakville (CA); Cuong Vong, Hamilton (CA); Edward Graham Zwartz, Mississauga (CA); Karen A. Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 13 days.

This patent is subject to a terminal disclaimer.

(21) Appl. No.: 12/718,296

(22) Filed: Mar. 5, 2010

(65) Prior Publication Data

US 2011/0217645 A1 Sep. 8, 2011

(51) Int. Cl.
*G03G 9/093* (2006.01)

(52) U.S. Cl. ..... 430/110.2; 430/108.2; 430/108.14; 430/109.4; 430/108.21; 430/137.11

(58) Field of Classification Search ..... 430/108.2, 430/108.21, 109.4, 110.2, 108.14, 137.11
See application file for complete search history.

(56) References Cited

U.S. PATENT DOCUMENTS

| | | | | |
|---|---|---|---|---|
| 3,590,000 | A | | 6/1971 | Palenniti at al. |
| 3,800,588 | A | | 4/1974 | Larson et al. |
| 3,847,604 | A | | 11/1974 | Hagenbach et al. |
| 3,967,962 | A | * | 7/1976 | O'Malley ..... 430/123.52 |
| 4,295,990 | A | | 10/1981 | Verbeek et al. |
| 4,298,672 | A | | 11/1981 | Lu |
| 4,338,390 | A | | 7/1982 | Lu |
| 4,935,326 | A | | 6/1990 | Creatura et al. |
| 4,937,166 | A | | 6/1990 | Creatura et al. |
| 5,236,629 | A | | 8/1993 | Mahabadi et al. |
| 5,260,158 | A | * | 11/1993 | Yamaji et al. ..... 430/108.21 |
| 5,273,853 | A | * | 12/1993 | Urano et al. ..... 430/108.21 |
| 5,278,020 | A | | 1/1994 | Grushkin |
| 5,290,654 | A | | 3/1994 | Sacripante et al. |
| 5,302,486 | A | | 4/1994 | Patel et al. |
| 5,308,734 | A | | 5/1994 | Sacripante et al. |
| 5,330,874 | A | | 7/1994 | Mahabadi et al. |
| 5,344,738 | A | | 9/1994 | Kmiecik-Lawrynowicz et al. |
| 5,346,797 | A | | 9/1994 | Kmiecik-Lawrynowicz et al. |
| 5,348,832 | A | | 9/1994 | Sacripante et al. |
| 5,364,729 | A | | 11/1994 | Kmiecik-Lawrynowicz et al. |
| 5,366,841 | A | | 11/1994 | Patel et al. |
| 5,370,963 | A | | 12/1994 | Patel et al. |
| 5,403,693 | A | | 4/1995 | Patel et al. |
| 5,405,728 | A | | 4/1995 | Hopper et al. |
| 5,418,108 | A | | 5/1995 | Kmiecik-Lawrynowicz et al. |
| 5,496,676 | A | | 3/1996 | Croucher et al. |
| 5,501,935 | A | | 3/1996 | Patel et al. |
| 5,527,658 | A | | 6/1996 | Hopper et al. |
| 5,582,950 | A | | 12/1996 | Katagiri et al. |
| 5,585,215 | A | | 12/1996 | Ong et al. |
| 5,607,803 | A | * | 3/1997 | Murofushi et al. ..... 430/108.1 |
| 5,650,255 | A | | 7/1997 | Ng et al. |
| 5,650,256 | A | | 7/1997 | Veregin et al. |
| 5,723,253 | A | | 3/1998 | Higashino et al. |
| 5,744,520 | A | | 4/1998 | Kmiecik-Lawrynowicz et al. |
| 5,747,215 | A | | 5/1998 | Ong et al. |
| 5,763,133 | A | | 6/1998 | Ong et al. |
| 5,766,818 | A | | 6/1998 | Smith et al. |
| 5,804,349 | A | | 9/1998 | Ong et al. |
| 5,827,633 | A | | 10/1998 | Ong et al. |
| 5,840,462 | A | | 11/1998 | Foucher et al. |
| 5,853,943 | A | | 12/1998 | Cheng et al. |
| 5,853,944 | A | | 12/1998 | Foucher et al. |
| 5,863,698 | A | | 1/1999 | Patel et al. |
| 5,869,215 | A | | 2/1999 | Ong et al. |
| 5,902,710 | A | | 5/1999 | Ong et al. |
| 5,910,387 | A | | 6/1999 | Mychajlowskij et al. |
| 5,916,725 | A | | 6/1999 | Patel et al. |
| 5,919,595 | A | | 7/1999 | Mychajlowskij et al. |
| 5,922,501 | A | | 7/1999 | Cheng et al. |
| 5,925,488 | A | | 7/1999 | Patel et al. |
| 5,928,829 | A | | 7/1999 | Cheng et al. |
| 5,977,210 | A | | 11/1999 | Patel et al. |
| 6,063,827 | A | | 5/2000 | Sacripante et al. |
| 6,214,507 | B1 | | 4/2001 | Sokol et al. |
| 6,576,389 | B2 | | 6/2003 | Vanbesien et al. |
| 6,593,049 | B1 | | 7/2003 | Veregin et al. |
| 6,617,092 | B1 | | 9/2003 | Patel et al. |
| 6,627,373 | B1 | | 9/2003 | Patel et al. |
| 6,638,677 | B2 | | 10/2003 | Patel et al. |
| 6,656,657 | B2 | | 12/2003 | Patel et al. |
| 6,656,658 | B2 | | 12/2003 | Patel et al. |
| 6,664,017 | B1 | | 12/2003 | Patel et al. |
| 6,673,505 | B2 | | 1/2004 | Jiang et al. |
| 6,704,538 | B2 | | 3/2004 | Nakamura et al. |
| 6,730,450 | B1 | | 5/2004 | Moffat et al. |
| 6,743,559 | B2 | | 6/2004 | Combes et al. |

(Continued)

FOREIGN PATENT DOCUMENTS

| | | | | |
|---|---|---|---|---|
| EP | 1 341 049 | | | 9/2003 |
| GB | 1442835 | | | 7/1976 |
| JP | 06222616 | A | * | 8/1994 |
| JP | 06250547 | A | * | 9/1994 |
| JP | A 2008-170866 | | | 7/2008 |
| JP | A 2009-169395 | | | 7/2009 |
| JP | 2009251138 | A | * | 10/2009 |

OTHER PUBLICATIONS

Engllish language translation of JP05-100487 (1993).*

English language machine translation of JP 2009-251138 (Oct. 2009).*

Search Report mailed Jun. 15, 2011 in corresponding GB Patent Application No. GB 1102952.7.

U.S. Appl. No. 12/576,289, filed Oct. 9, 2009.

*Primary Examiner* — Christopher Rodee

(74) *Attorney, Agent, or Firm* — Oliff & Berridge, PLC

(57) ABSTRACT

A toner and method for making a toner that includes an amorphous resin, a crystalline resin, and a cyanine dye. The cyanine dye improves heat cohesion without negatively effecting other desirable properties.

9 Claims, No Drawings

U.S. PATENT DOCUMENTS

| | | | | |
|---|---|---|---|---|
| 6,756,176 | B2 | 6/2004 | Stegamat et al. | |
| 6,780,500 | B2 | 8/2004 | Dumouchel | |
| 6,830,860 | B2 | 12/2004 | Sacripante et al. | |
| 7,029,817 | B2 | 4/2006 | Robinson et al. | |
| 7,087,354 | B2 * | 8/2006 | Nakamura et al. | 430/108.21 |
| 7,141,761 | B1 | 11/2006 | Dirubio et al. | |
| 7,235,337 | B2 | 6/2007 | Kameyama et al. | |
| 7,316,879 | B2 | 1/2008 | Nakamura et al. | |
| 7,329,476 | B2 | 2/2008 | Sacripante et al. | |
| 7,410,739 | B2 | 8/2008 | Nakamura et al. | |
| 7,510,811 | B2 | 3/2009 | Matsumura et al. | |
| 2003/0049553 | A1 * | 3/2003 | Nakamura et al. | 430/108.21 |
| 2003/0129516 | A1 * | 7/2003 | Nakamura et al. | 430/108.21 |
| 2003/0180645 | A1 * | 9/2003 | Tavernier et al. | 430/109.4 |
| 2004/0037596 | A1 | 2/2004 | Nakamura et al. | |
| 2004/0131962 | A1 * | 7/2004 | Nakamura et al. | 430/108.21 |
| 2004/0142263 | A1 * | 7/2004 | Mikuriya et al. | 430/108.2 |
| 2004/0142266 | A1 * | 7/2004 | Sacripante et al. | 430/109.3 |
| 2006/0019187 | A1 * | 1/2006 | Nakamura | 430/108.1 |
| 2006/0204880 | A1 * | 9/2006 | Mizutani et al. | 430/109.4 |
| 2006/0222991 | A1 | 10/2006 | Sacripante et al. | |
| 2006/0223934 | A1 | 10/2006 | Chen et al. | |
| 2007/0287089 | A1 * | 12/2007 | Kimura et al. | 430/108.2 |
| 2008/0070142 | A1 | 3/2008 | Furuki et al. | |
| 2008/0107989 | A1 | 5/2008 | Sacripante et al. | |
| 2008/0107990 | A1 * | 5/2008 | Field et al. | 430/109.4 |
| 2008/0199797 | A1 | 8/2008 | Sacripante et al. | |
| 2008/0236446 | A1 | 10/2008 | Zhou et al. | |
| 2008/0241716 | A1 | 10/2008 | Ishikawa et al. | |
| 2008/0268365 | A1 * | 10/2008 | Yamazaki et al. | 430/109.4 |
| 2009/0087767 | A1 | 4/2009 | Nakamura | |
| 2009/0220882 | A1 * | 9/2009 | Zhou et al. | 430/109.3 |
| 2009/0305159 | A1 * | 12/2009 | Zhou et al. | 430/110.2 |
| 2010/0203439 | A1 * | 8/2010 | Zhou et al. | 430/108.6 |
| 2011/0086303 | A1 * | 4/2011 | Zhou et al. | 430/105 |

* cited by examiner

TONER COMPOSITIONS AND METHODS

TECHNICAL FIELD

This disclosure is directed to ultra-low-melt (ULM) toner compositions with improved heat cohesion, methods of making such toner compositions, and methods of forming images with such toner compositions.

BACKGROUND

ULM toners have numerous advantages over conventional toners. Most signigicantly, ULM toners melt at very low temperatures thus providing a toner system with relatively minor energy requirements.

Conventional ULM toners frequently comprise both an amorphous and a crystalline resin. However, this combination typically results in poor heat cohesion due to the plastisization of the amorphous resin by the crystalline resin. U.S. Patent Application Publication No. 2009/0220882 describes a toner particle designed to overcome this problem by using a core-shell approach, where the shell comprises only the amorphous resin. However, the toner blocking needs to be further improved due to the protrusion of crystalline material to the toner surface.

SUMMARY

Exemplary toners provide superior print quality while meeting requirements of typical printing processes. The present disclosure in embodiments addresses these various needs and problems by providing a toner that comprises an amorphous resin, a crystalline resin, and a cyanine dye; methods for making such toners; and methods of forming images with such toners. The cyanine dye improves heat cohesion without negatively effecting other desirable properties. For example, the resulting toner has acceptable charging performance and blocking.

These and other improvements are accomplished by the compositions and methods described in embodiments herein.

EMBODIMENTS

This disclosure is not limited to particular embodiments described herein, and some components and processes may be varied by one of ordinary skill, based on this disclosure.

In this specification and the claims that follow, singular forms such as "a," "an," and "the" include plural forms unless the content clearly dictates otherwise. All ranges disclosed herein include, unless specifically indicated, all endpoints and intermediate values. In addition, reference may be made to a number of terms that shall be defined as follows:

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs.

Resins and Polymers

In embodiments, various toners, such as styrene acrylate toners, UV curable toners, and polyester toners, may be made that incorporate a cyanine dye. Thus, the toner particles include at least one resin or a mixture of two or more resins, for example, the toner particles may include a styrene resin, a UV curable resin, and/or a polyester resin.

Styrene resins and polymers are known in the art. In embodiments, specific styrene resins may be, for example, styrene-based monomers, including styrene acrylate-based monomers. Illustrative examples of such resins may be found, for example, in U.S. Pat. Nos. 5,853,943; 5,922,501; and 5,928,829, the entire disclosures thereof being incorporated herein by reference.

Specific examples include, but are not limited to, poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

UV curable resins are known in the art. In embodiments, UV curable resins may be unsaturated polymers that can be crosslinked in the presence of activating radiation such as ultraviolet light and a suitable photo initiator. Illustrative examples of such resins may be found, for example, in U.S. Patent Application Publication No. 2008-0199797, the entire disclosure thereof being incorporated herein by reference.

Polyester resins are also known in the art. The specific polyester resin or resins selected for the present disclosure include, for example, unsaturated polyester and/or its derivatives, polyimide resins, branched polyimide resins, and any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous. Illustrative examples of such resins may be found, for example, in U.S. Pat. Nos. 6,593,049, 6,756,176, and 6,830,860, the entire disclosures thereof being incorporated herein by reference.

The resin may be a polyester resin formed by reacting a diol with a diacid in the presence of acatalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mol %, such as from about 42 to about 55 mol %, or from about 45 to about 53 mol % of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, from about 40 to about 60 mol %, such as from about 42 to about 55 mol %, or from about 45 to about 53 mol %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as polyethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), pol(decylene-decanoate), poly-(ethylene-decanoate), poly-(ethylene-dodecanoate), poyl(nonylene-sebacate), poly (nonylene-decanoate), copoly(ethylene-fumarate)-copyl)-(ethylene-sebacate), copoly(ethylene-fumarate)-copyl)-(ethylene-decanoate), and copoly (ethylene-fumarate)-copyl)-(ethylene-dodecanoate), and combinations thereof.

The crystalline resin may be present, for example, in an amount of from about 5 to about 50 wt % of the toner components, such as from about 10 to about 35 wt % of the toner components. The crystalline resin can possess various melting points of, for example, from about 30° C. to about 120° C., such as from about 50° C. to about 90° C. The crystalline resin may have a number average molecular weight ($M_n$), as measured by gel permeation chromatography (GPC) of, for example, from about 1,000 to about 50,000, such as from about 2,000 to about 25,000, and a weight average molecular weight ($M_w$) of, for example, from about 2,000 to about 100,000, such as from about 3,000 to about 80,000, as determined by GPC using polystyrene standards. The molecular weight distribution ($M_w/M_n$) of the crystalline resin may be, for example, from about 2 to about 6, such as from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mol % of the resin, such as from about 42 to about 55 mol % of the resin, or from about 45 to about 53 mol % of the resin.

Examples of diols used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mol % of the resin, such as from about 42 to about 55 mol % of the resin, or from about 45 to about 53 mol % of the resin.

Polyeondensation catalysts that may be used for either the crystalline or amorphous polyesters include tetraalkyl titanates such as titanium (iv) butoxide or titanium (iv) iso-propoxide, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be used in amounts of, for example, from about 0.001 mol % to about 0.55 mol % based on the starting diacid or diester used to generate the polyester resin.

Suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins include poly (styrene-acrylate) resins, crosslinked, for example, from about 10% to about 70%, poly(styrene-acrylate) resins, poly (styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be used, such as the metal or alkali salts of copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly (propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers include poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); polystyrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), and combinations thereof. The polymers may be block, random, or alternating copolymers.

An unsaturated polyester resin may be used as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly (butyloxylated bisphenol co-itaconate), poly(co-propoxylated bisphenol co-ethoxylated bisphenol co-itaconate), poly (1,2-propylene itaconate), and combinations thereof.

A suitable amorphous polyester resin may be a poly(propoxylated bisphenol A co-fumarate) resin having the following formula (I):

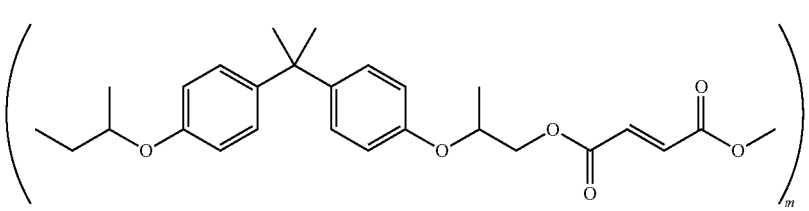

(I)

where m may be from about 5 to about 1000.

An example of a linear propoxylated bisphenol A fumarate resin that may be used as a latex resin is available under the trade name SPARII from Resana S/A Industrias Quimicas, Sao Paulo Brazil. Other commercially available propoxylated bisphenol A fumarate resins include GTUF and FPESL-2 from Kao Corporation, Japan, and EM181635 from Reichhold, Research Triangle Park, N.C., and the like. Other suitable amorphous resins include those disclosed in U.S. Pat. No. 7,235,337, the entire disclosure of which is incorporated herein by reference.

Suitable crystalline resins include those disclosed in U.S. Pat. Nos. 7,329,476 and 7,510,811, the disclosures of which are hereby incorporated by reference in their entirety. The crystalline resin may be composed of ethylene glycol and a mixture of dodecanedioic acid and fumaric acid co-monomers with the following formula:

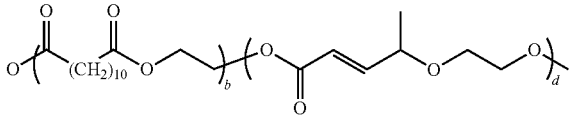

(II)

where b is from about 5 to about 2000 and d is from about 5 to about 2000.

One, two, or more toner resins/polymers may be used. In embodiments where two or more toner resins are used, the toner resins may be in any suitable ratio (e.g., weight ratio) such as, for instance, about 10% first resin:90% second resin to about 90% first resin:10% second resin. An amorphous resin used in the core may be linear.

The resin may be formed by emulsion polymerization methods, or may be a pre-made resin.

Cyanine Dyes

The toners may include at least one cyanine dye or a mixture of two or more cyanine dyes. The cyanine dye may be uniformly distributed throughout the toner particles. The cyanine dye serves to improve heat cohesion, and may also optionally serve as an IR absorber.

Any suitable cyanine dye may be used. Cyanine dyes include streptocyanines having the formula $R_2N^+{=}CH[CH{=}CH]_n{-}NR_2$, hemicyanines having the formula $Aryl{=}N^+{=}CH[CH{=}CH]_n{-}NR_2$, and closed cyanines having the formula $Aryl{=}N^+{=}CH[CH{=}CH]_n{-}N{=}Aryl$; where n is an integer of from about 1 to about 6, $R_2$ is a substituted or unsubstituted alkyl group having from about 1 to about 20 carbon atoms, and Aryl is a substituted or unsubstituted aryl group.

Cy3 and Cy5 dyes may be used. Cy3 dyes are excited maximally at about 550 nm and emit maximally at about 570 nm. Cy5 dyes are excited maximally at about 649 nm and emit maximally at about 670 nm. These dyes are represented by the following general formulas (III) and (IV):

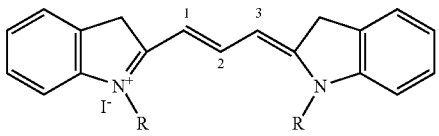

(III)

Cy3

-continued (IV)

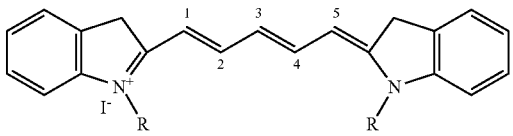

Cy5 where each R groups independently represents a short aliphatic chain, one or both of which may be reactive moieties such as N-hydroxysuccinimide or malemide.

Other illustrative cyanine dyes include those having the following formula (V):

(V)

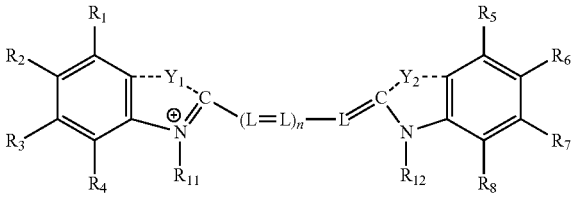

wherein:

$R_1$, $R_2$, $R_3$, $R_4$, $R_5$, $R_6$, $R_7$, and $R_8$ are each independently selected from a group consisting of: hydrogen, $C_1$-$C_6$ alkyl groups, a $C_0$-$C_4$ alkyl group having a hydrophilic substituent selected from a group consisting of sulfonate, carboxylate, hydroxyl, substituted amines and quaternary amines, such that at least one of $R_1$-$R_{10}$, $R_9$' and $R_{10}$' is the $C_0$-$C_4$ alkyl group having the hydrophilic substituent;

$Y_1$ and $Y_2$ are each independently selected from a group consisting of: carbon atom, oxygen atom, nitrogen, sulfur, and groups of —S—C—, —N—C—, —O—C—, —C—C—, and the like, wherein the atoms or groups can be further substituted with $C_1$-$C_6$ alkyl or a heteroatom substituted $C_1$-$C_6$ alkyl wherein the heteroatom is O, N or S;

$R_{11}$ and $R_{12}$ are each independently selected from a group consisting of $R_{14}H$, $R_{14}SH$ and $R_{14}OH$; wherein $R_{14}$ is selected from a group consisting of: $C_3$-$C_{30}$ alkyl and $C_3$-$C_{30}$ alkyl having a phenyl, hydroxyl, sulfonyl, or halogen atom or a heteroatom substituted phenyl; and L is selected from a group consisting of: methine, a methine group having a substituent $C_1$-$C_{30}$ alkyl group and a methine group having a substituted $C_1$-$C_{30}$ alkyl group having a phenyl, hydroxyl, sulfonyl, a halogen atom, a heteroatom substituted phenyl or a $C_1$-$C_4$ alkoxyl; where n is 1, 2, 3 or greater as an active ingredient together with instruction for the use thereof as a dye or hapten.

Specifically, illustrative cyanine dyes includes those having the following formula (VI):

(VI)

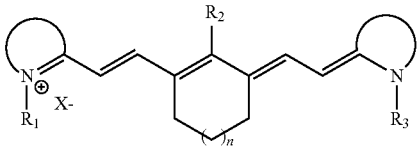

wherein:

n is 0, 1, or 2;

R1 and R3 are independently substituted or unsubstituted alkyl groups having from about 1 to about 20 carbon atoms, such as methyl, ethyl, propyl, butyl, and the like;

R2 is selected from the group consisting of a halogen, a hydrocarbon group containing 1 to about 18 carbon atoms, a heteroatom-containing group such as thienyl and amino groups;

$X^-$ may be any suitable counter ion such as $BF_4^-$, $Cl^-$, $ClO4^-$, Br—, I—, and the like; and the cyclic groups (substituted or unsubstituted) at the both ends containing about 4 to about 28 carbon atoms.

Examples of a cyanine dyes include:

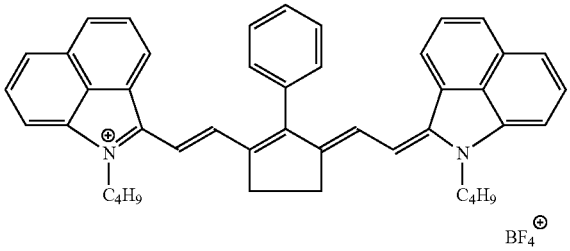

1-Butyl-2-(2-[3-[2-(1-butyl-1H-benzo[cd]indol-2-ylidene)-ethylidene]-2-phenyl-cyclopent-1-enyl]-vinyl)-benzo[cd]indolium tetrafluoroborate, commercially available as S-0813 from FEW Chemicals GmbH, Germany;

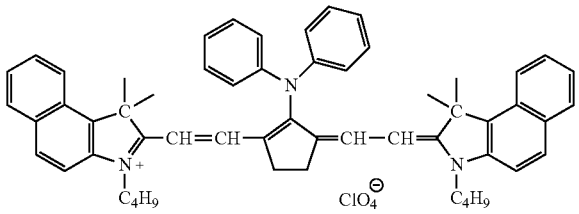

commercially available as NK2911 from Hayashibara Biochemical laboratories, Inc., Japan; and

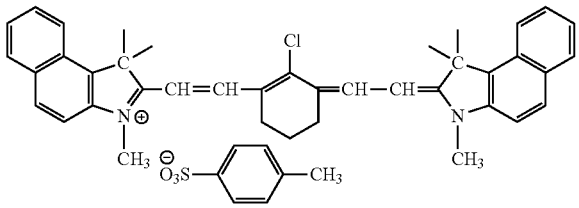

commercially available as NK4680 from Hayashibara Biochemical laboratories, Inc., Japan.

The cyanine dye may be present in the toner in any effective amount, such as from about 0.01 to about 5 wt % of the toner, such as from about 0.02 to about 3 wt %, or from about 0.05 to about 2 wt %, or from about 0.1 to about 1 wt %.

Surfactants

In embodiments, one, two, or more surfactants may be used to form emulsions by contacting the resin, cyanine dye, and/or other components with one or more surfactants. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt %, or from about 1 to about 3 wt %.

Examples of nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenac as IGEPAL CA-210™, IGEPAL CA-520™, IGEPAL CA-720™, IGEPAL CO-890™, IGEPAL CO-720™, IGEPAL-CO290™, IGEPAL CA-210™, ANTAROX 890™, and ANTAROX 897™. Other examples include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of suitable cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical. Company, SANIZOL™ (benzalkonium chloride), available from Kao Chemicals, and the like, and mixtures thereof.

Waxes

The toner particles may include one or more waxes. In these embodiments, the emulsion will include resin and wax particles at the desired loading levels, which allows for a single resin and wax emulsion to be made rather than separate resin and wax emulsions. The combined emulsion allows for reduction in the amount of surfactant needed to prepare separate emulsions for incorporation into toner compositions. This is particularly helpful in instances where it would otherwise be difficult to incorporate the wax into the emulsion. However, the wax may also be separately emulsified, such as with a resin, and separately incorporated into final products.

In addition to the polymer binder resin, the toners may also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes, and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 500 to about 2,000, such as from about 1,000 to about 1,500, while the commercially available polypropylenes have a molecular weight of about 1,000 to about 10,000. Examples of functionalized waxes include amines, amides, imides, esters, quaternary amines, carboxylic acids, or acrylic polymer emulsion, for example, JONCRYL 74, 89, 130, 537, and 538, all available from Johnson Diversey, chlorinated polypropylenes, and polyethylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of toner, such as from about 3 to about 15 wt % of the toner, on a dry basis; or from about 5 to about 20 wt % of the toner, such as from about 5 to about 11 wt % of the toner.

Colorants

The toner particles may also include at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, mixtures thereof, in an amount of about 0.1 to about 35 wt % based upon the total weight of the composition, such as from about 1 to about 25 wt %. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green. L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like, and mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like, and mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %. However, amounts outside these ranges can also be used.

Coagulants

The emulsion aggregation process for making toners of the present disclosure uses at least one coagulant, such as a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from 0 to about 5 wt % of the toner particles, such as from about greater than 0 to about 3 wt % of the toner particles.

Emulsion Aggregation Processes

Any suitable emulsion aggregation process may be used and modified in forming the toner particles without restriction. Emulsion aggregation processes generally include the steps of emulsifying, aggregating, coalescencing, washing, and drying. United States patent documents describing emulsion aggregation toners include, for example, U.S. Pat. Nos.

5,278,020; 5,290,654; 5,308,734; 5,344,738; 5,346,797; 5,348,832; 5,364,729; 5,366,841; 5,370,963; 5,403,693; 5,405,728; 5,418,108; 5,496,676; 5,501,935; 5,527,658; 5,585,215; 5,650,255; 5,650,256; 5,723,253; 5,744,520; 5,747,215; 5,763,133; 5,766,818; 5,804,349; 5,827,633; 5,840,462; 5,853,944; 5,863,698; 5,869,215; 5,902,710; 5,910,387; 5,916,725; 5,919,595; 5,925,488; 5,977,210; 6,576,389; 6,617,092; 6,627,373; 6,638,677; 6,656,657; 6,656,658; 6,664,017; 6,673,505; 6,730,450; 6,743,559; 6,756,176; 6,780,500; 6,830,860; and 7,029,817; and U.S Patent Application Publication No. 2008/0107989 the entire disclosures of which are also incorporated herein by reference. These procedures may be modified to facilitate the inclusion of a cyanine dye to improve heat cohesion.

Thus, in embodiments, the emulsion aggregation process may include the basic process steps of aggregating an emulsion containing a polymer binder, a cyanine dye, an optional wax, an optional colorant, a surfactant, and an optional coagulant to form aggregated particles; freezing the growth of the aggregated particles; coalescing the aggregated particles to form coalesced particles; and then isolating, optionally washing, and optionally drying the toner particles.

Emulsion Formation. If the resin and cyanine dye have solubility parameters that are similar, the same solvent may be used to dissolve the resin and cyanine dye to produce a homogeneous solution. The resin and cyanine dye may be emulsified together. However, when the resin and cyanine dye emulsions are not prepared together, the resin may be added to a prepared cyanine dye emulsion, the cyanine dye may be added to a prepared resin emulsion, or a prepared cyanine dye emulsion may be added to a prepared resin emulsion. The emulsions may be emulsified mechanically or chemically.

For example, phase inversion emulsification (PIE) may be used where both the cyanine dye and the resin are dissolved in a suitable solvent. Water may be added to the solvent until separation of the solvent and water occurs under mixing. The solvent may be removed by vacuum distillation and an emulsion of polymer and cyanine dye micro-spheres in water results. Illustrative examples of PIE processes may be found in U.S. Pat. No. 7,029,817; U.S. Patent Application Publication No. 2006/0223934; and U.S. Patent Application Publication No. 2008/0236446, the entire disclosures of which are incorporated herein by reference.

The emulsion may be prepared by dissolving a resin and/or cyanine dye in a solvent. Suitable solvents include alcohols, ketones, esters, ethers, chlorinated solvents, nitrogen containing solvents, and mixtures thereof. Specific examples of suitable solvents include isopropyl alcohol, acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, and mixtures thereof. The resin/cyanine dye may be dissolved in a solvent at an elevated temperature of from about 40° C. to about 80° C., such as from about 50° C. to about 70° C., or from about 60° C. to about 65° C. The resin/cyanine dye may be dissolved at a temperature below the boiling point of the solvent, such as from about 2° C. to about 15° C., or from about 5° C. to about 10° C. below the boiling point of the solvent, and at a temperature lower than the glass-transition temperature of the resin/cyanine dye.

After being dissolved in a solvent, the dissolved resin/cyanine dye may be mixed into an emulsion medium, for example water, such as deionized water, containing an optional stabilizer and an optional surfactant.

Next, the mixture may be heated to flash off the solvent, and then cooled to room temperature. The solvent flashing may be conducted at any suitable temperature above the boiling point of the solvent in water that will flash off the solvent, such as from about 60° C. to about 100° C., from about 70° C. to about 90° C., or about 80° C., although the temperature may be adjusted. Solvent flashing is typically performed under vacuum to increase the solvent stripping rate. An optional defoamer may be added to decrease foam generation during solvent stripping Following the solvent flash step, the resin/cyanine dye emulsion may have an average particle diameter in the range of from about 50 nm to about 600 nm, such as from about 100 nm to about 300 nm as measured with a Honeywell MICROTRAC UPA150 particle size analyzer.

An emulsion may be prepared by agitating in water a mixture of one or more of an optional nonionic surfactant, such as polyethylene glycol or polyoxyethylene glycol nonyl phenyl ether, an optional anionic surfactant, such as sodium dodecyl sulfonate or sodium dodecyl benzenesulfonate, a resin, and/or a cyanine dye.

The resulting emulsion sized resin/cyanine dye particles may have a volume average diameter of from about 20 nm to about 1200 nm specifically including all sub-ranges and individual values within the range of about 20 nm to about 1200 nm. The resulting emulsion, which typically contains from about 20% to about 60% solids, may be diluted with water to about 15% solids. A cyanine dye or resin may be added at this point to the emulsion if such a component has not been previously added or if additional resins or cyanine dyes are desirable that were not included in the above formed emulsion processes.

Additional optional additives, such as additional surfactants, colorants, waxes, and coagulants, may be added to the emulsion.

Aggregation. The resin-cyanine dye-optional additive mixture is then homogenized, for example, at from about 2000 to about 6000 rpm, to form statically bound pre-aggregated particles. The statically bound pre-aggregated particles are then heated to an aggregation temperature that is below the glass-transition temperature of the resin to form aggregated particles. For example, the pre-aggregated particles may be heated to an aggregation temperature of from about 40° C. to about 60° C., such as from about 30° C. to about 50° C. or from about 35° C. to about 45° C. The particles may be maintained at the aggregation temperature for a duration of time of, for example, from about 30 minutes to about 600 minutes, such as from about 60 minutes to about 400 minutes, or from about 200 minutes to about 300 minutes.

At this point, the particle size and distribution may be "frozen" by pH adjustment, and may be optionally coalesced to form polymeric toner particles of a controlled size with narrow size distribution.

Optionally, a shell may be added to the core by conventional methods prior to coalescence. The shell may be configured to include or exclude the cyanine dye.

Coalescence. After freezing the growth of the aggregated particles at the desired size, the aggregated particles may optionally again be heated to a coalescence temperature at or above the glass-transition temperature of the resin to coalesce the aggregated particles into coalesced particles. For example, the aggregated particles may be heated to a coalescence temperature of from about 60° C. to about 100° C., such as from about 70° C. to about 90° C., or from about 75° C. to about 85° C. The particles may be maintained at the coalescence temperature for a duration of time of, for example, about 30 minutes to about 600 minutes, such as from about 60 minutes to about 400 minutes, or from about 200 minutes to about 300 minutes.

Once the toner particles are formed, they may be isolated from the reaction mixture by any suitable means. Suitable isolation methods include filtration, particle classification, and the like.

The formed toner particles may optionally be washed, dried, and/or classified by any known conventional means. For example, the formed toner particles can be washed using, for example, water, deionized water, or other suitable materials. The formed toner particles may likewise be dried using, for example, a heated drying oven, a spray dryer, a flash dryer, pan dryer freeze dryer, or the like.

Following the optional particle classification, washing and/or drying, the polymeric particles may be subjected to an optional chemical surface treatment. For example, the polymeric particles may be subjected to any desirable surface treatment to alter the chemical and/or physical properties of the particle, such as hydrophobicity, hydrophilicity, surface charge, and the like, or to attach or alter functional groups present on the surface of the particles.

The toner emulsion aggregation particles may be made to have a small size (VolD50), for example, from about 3 μm to about 10 μm, from about 5.2 μm to about 6 μm, or about 5.6 μm.

Due to the emulsion aggregation process, the toner particles have an excellent particle size distribution, particularly compared to the scattered distribution typically exhibited from polymeric particles prepared by grinding techniques. The toner particles may have an upper geometric standard deviation by volume ($GSD_V$) in the range of from about 1.15 to about 1.30, such as about 1.18 to about 1.23; and a lower geometric standard deviation by number ($GSD_N$) in the range of from about 1.20 to about 1.40, such as about 1.20 to about 1.30. These GSD values indicate that the particles have a very narrow particle size distribution. The upper GSD is calculated from the cumulative volume percent finer than measurement and is the ratio of the 84% finer than (D84v) by volume to the 50% finer than (D50v) by volume; it is often notated D84/50v. The lower GSD is calculated from the number percent finer than measurement and is the ratio of the 50% finer than (D50n) by number to the 16% finer than (D16n) by number; it is often notated as D50/16n.

In addition, particles can have specific shapes depending on the process conditions, which can be important parameters in various end-product uses. Thus, the particle shape may also be controlled. The particles may have a shape factor of about 105 to about 170, such as about 110 to about 160, SF1*a. Scanning electron microscopy (SEM) is used to determine the shape factor analysis of the particles by SEM and image analysis (IA) is tested. The average particle shapes are quantified by employing the following shape factor (SF1*a) formula: $SF1*a=100\,\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

In addition to measuring shape factor, another metric to measure particle circularity uses an FPIA-2100 or FPIA 3000, manufactured by Sysmex. This method more quickly quantifies the particle shape. A completely circular sphere has a circularity of 1.000. In some embodiments, the particles have a circularity of about 0.920 to 0.990, such as from about 0.950 to about 0.985.

Optional Additives

The toner particles may be blended with other optional additives, as desired or required. For example, the toner particles may be blended with flow aid additives thereby presenting such additives on the surface of the toner particles. Examples of these additives include metal oxides such as titanium oxide, silicon oxide, tin oxide, mixtures thereof, and the like; colloidal and amorphous silicas, such as AEROSIL®; and metal salts and metal salts of fatty acids such as zinc stearate, aluminum oxides, cerium oxides, and mixtures thereof. Each of these external additives may be present in an amount of from about 0.1 to about 5 wt % of the toner, such as from about 0.25 to about 3 wt %. Suitable additives include those disclosed in U.S. Pat. Nos. 3,590,000, 3,800,588, and 6,214,507, the disclosures of each of which are hereby incorporated by reference in their entirety.

The toner may have a relative humidity sensitivity of, for example, from about 0.5 to about 10, such as from about 0.5 to about 5. Relative humidity (RH) sensitivity is a ratio of the charging of the toner at high humidity conditions to charging at low humidity conditions. That is, the RH sensitivity is defined as the ratio of toner charge at 15% relative humidity and a temperature of about 12° C. (denoted herein as C-zone) to toner charge at 85% relative humidity and a temperature of about 28° C. (denoted herein as A-zone); thus, RH sensitivity is determined as (C-zone charge)/(A-zone charge). Ideally, the RH sensitivity of a toner is as close to 1 as possible, indicating that the toner charging performance is the same in low and high humidity conditions, that is, that the toner charging performance is unaffected by the relative humidity.

Toners prepared in accordance with the present disclosure possess excellent heat cohesion/blocking performance and improved charging performance, with Q/m (Toner charge per mass ratio) in A- and C-zone of from about −3 to about −60 microcoulombs per gram, such as from about −4 to about −50 microcoulombs per gram. Such toners may have an onset of heat cohesion (HC) greater than about 50° C., such as greater than about 52° C. Such toners have a significantly increased heat cohesion over corresponding toners. A corresponding toner is a toner that has the same or similar components except that it does not include the cyanine dye component. The increased heat cohesion improves the toner blocking performance. For example, toners with the cyanine dye component of the present disclosure have an improved blocking performance, when compared to corresponding toners without the cyanine dye, of from about 3° C. to about 8° C., such as from about 4° C. to about 7° C., or from about 5° C. to about 6° C.

In accordance with the present disclosure, the charging of the toner particles may be enhanced, so less surface additives may be required, and the final toner charging may thus be higher to meet machine charging requirements.

Developers

The toner particles may be formulated into developer compositions by mixing the toner particles with carrier particles to achieve a two-component developer composition. The toner concentration in the developer may be from about 1 to about 25 wt % of the total weight of the developer, such as from about 2 to about 15 wt %.

Carriers. Examples of carrier particles that may be used for mixing with the toner particles include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326, the disclosures of each of which are totally incorporated herein by reference.

The selected carrier particles may be used with or without a coating. The carrier particles may include a core with a coating thereon which may be formed from a mixture of polymers that are not in close proximity thereto in the triboelectric series. The coating may include fluoropolymers, such as polyvinylidene fluoride resins, terpolymers of styrene, methyl methacrylate; and/or silanes, such as triethoxy silane, tetrafluoroethylenes; other known coatings; and the like. For example, coatings containing polyvinylidenefluoride (for example, commercially available as KYNAR 301F™) and/or polymethylmethacrylate (PMMA) having a weight average molecular weight of about 300,000 to about 350,000 (commercially available from Soken) may be used. Polyvinylidenefluoride and PMMA may be mixed in proportions of from about 30 to about 70 wt % to about 70 to about 30 wt %, such as from about 40 to about 60 wt % to about 60 to about 40 wt %. The coating may have a coating weight of, for example, from about 0.1 to about 5 wt % of the carrier, such as from about 0.5 to about 2 wt %.

PMMA may optionally be copolymerized with any desired comonomer, so long as the resulting copolymer retains a suitable particle size. Suitable comonomers can include monoalkyl or dialkyl amines such as a dimethylaminoethyl methacrylate, diethylaminoethyl methacrylate, diisopropylaminoethyl methacrylate, t-butylaminoethyl methacrylate, and the like. The carrier particles may be prepared by mixing the carrier core with the polymer in an amount from about 0.05 to about 10 wt % based on the weight of the coated carrier particles, such as from about 0.01 to about 3 wt %, until adherence thereof to the carrier core by mechanical impaction and/or electrostatic attraction.

Various effective suitable means may be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

Suitable carriers may include a steel core of, for example, from about 25 μm to about 100 μm in size, such as from about 50 μm to about 75 μm; coated with about 0.5 to about 10 wt %, such as from about 0.7 to about 5 wt %, of a conductive polymer mixture including, for example, methylacrylate and carbon black using the process described in U.S. Pat. Nos. 5,236,629 and 5,330,874, the disclosures of each of which are totally incorporated herein by reference.

The carrier particles may be mixed with the toner particles in various suitable combinations. The concentrations may be from about 1 to about 20 wt % of the toner composition. However, different toner and carrier percentages may be used to achieve a developer composition with desired characteristics.

EXAMPLES

Comparative Example 1

Control Toner with No IR Absorber 183.25 g amorphous resin (XP777) emulsion (45.84 wt %) and 56.00 g unsaturated CPE resin emulsion (UCPE, 30 wt %) were added into a 2 L glass reactor equipped with an overhead stirrer and heating mantle. 41.82 g of $Al_2(SO_4)_3$ solution (1 wt %) was added as a flocculent under homogenization. The mixture was subsequently heated to 47.2° C. for aggregation at 300 rpm. The particle size was monitored with a Coulter Counter until the core particles reached a volume average particle size of 5.20 with a GSD of 1.23. Then, 85.52 g of the above XP777 resin emulsion was added as a shell, resulting in core-shell structured particles with an average particle size of 6.75 μm and a GSD of 1.22. Thereafter, the particle growth was frozen by increasing the pH of the reaction slurry to 6.9 using 1.615 g EDTA (39 wt %) and NaOH (4 wt %). After freezing particle growth, the reaction mixture was heated to 69.9° C., and the pH was reduced to 5.9 for coalescence. After coalescence, the toner was quenched, cooled to room temperature, separated by sieving (25 μm) filtration, washed, and freeze dried. The final toner particles had a final particle size of 6.28 μm, a GSD of 1.23, and a circularity of 0.982.

Example 1

Toner with 0.2 Wt % NK-2911 a. Preparation of emulsion containing resin and NK-2911. 120 g amorphous resin (XP777) and 0.24 g NK-2911 IR absorber were measured into a 2 L beaker containing about 900 g of ethyl acetate. The mixture was stirred at about 300 rpm at room temperature to dissolve the resin and IR absorber in the ethyl acetate. 2.56 g of sodium bicarbonate were measured into a 3 L Pyrex glass flask reactor containing about 700 g of deionized water. Homogenization of said water solution in said 3 liter glass flask reactor was commenced with an IKA Ultra Turrax T50 homogenizer at 4,000 rpm. The resin solution was then slowly poured into the water solution as the mixture continued to be homogenized, the homogenizer speed was increased to 8,000 rpm and homogenization was carried out at these conditions for about 30 minutes. Upon completion of homogenization, the glass flask reactor and its contents were placed in a heating mantle and connected to a distillation device. The mixture was stirred at about 275 rpm and the temperature of the mixture was increased to 80° C. at about 1° C. per minute to distill off the ethyl acetate from the mixture. Stirring of the mixture was continued at 80° C. for about 180 minutes followed by cooling to about 2° C. per minute to room temperature. The product was screened through a 25 μm sieve. The resulting resin emulsion was comprised of about 19.61 percent by weight solids in water, and had an average particle size at 135 nm.

b. Preparation of toner containing 0.2 wt % NK-2911. 367.16 g of the amorphous resin and IR absorber emulsion of Example 1a. and 48 g unsaturated CPE resin emulsion (UCPE, 30 wt %) were added into a 2 L glass reactor equipped with an overhead stirrer and heating mantle. 35.84 g of $Al_2(SO_4)_3$ solution (1 wt %) was added as a flocculent under homogenization. The mixture was subsequently heated to 40.8° C. for aggregation at 260 rpm. The particle size was monitored with a Coulter Counter until the core particles reached a volume average particle size of 4.54 μm with a GSD of 1.21. Then, 171.34 g of the above resin and IR absorber emulsion was added as a shell, resulting in a core-shell structured particles with an average particle size of 5.77 μm and a GSD of 1.22. Thereafter, the particle growth was frozen by increasing the pH of the reaction slurry was then increased to 7.25 using 1.39 g EDTA (39 wt %) and NaOH (4 wt %). After freezing particle growth, the reaction mixture was heated to 69° C., and the pH was reduced to 5.9 for coalescence. After coalescence, the toner was quenched, cooled to room temperature, separated by sieving (25 μm), washed, and freeze dried. The final toner particles had a final particle size of 5.77 μm, a GSD of 1.24, and a circularity of 0.983.

Example 2

Toner with 0.2 Wt % NK-4680 a. Preparation of emulsion containing resin and NK-4680. This emulsion was prepared following the same procedure as outlined in Example 1a, except the IR absorber NK4680 was used instead of NK2911.

b. Preparation of toner containing 0.2 wt % NK-4680. 363.09 g of the amorphous resin and IR absorber emulsion of Example 2a. and 48 g unsaturated CPE resin emulsion (UCPE, 30 wt %) were added into a 2 L glass reactor equipped with an overhead stirrer and heating mantle. 35.84 g of $Al_2(SO_4)_3$ solution (1 wt %) was added as a flocculent under homogenization. The mixture was subsequently heated to 40.3° C. for aggregation at 250 rpm. The particle size was monitored with a Coulter Counter until the core particles reached a volume average particle size of 4.63 μm with a GSD of 1.23. Then, 169.44 g of the above resin and IR absorber emulsion was added as a shell, resulting in a core-shell structured particles with an average particle size of 5.60 μm and a GSD of 1.23. Thereafter, the particle growth was frozen by increasing the pH of the reaction slurry was then increased to 7.6 using 1.39 g EDTA (39 wt %) and NaOH (4 wt %). After freezing particle growth, the reaction mixture was heated to 69.3° C., and the pH was reduced to 5.9 for coalescence. After coalescence, the toner was quenched, cooled to room temperature, separated by sieving (25 μm), washed, and freeze dried. The final toner particles had a final particle size of 5.60 μm, a GSD of 1.23, and a circularity of 0.970.

Example 3

Toner with 0.2 Wt % S-0813 a. Preparation of emulsion containing resin and S-0813. This emulsion was prepared following the same procedure as outlined in Examples 1a and 2a, except the IR absorber S-0813 was used instead of NK2911 or NK-4680.

b. Preparation of toner containing 0.2 wt % S-0813. 311.02 g of the amorphous resin and IR absorber emulsion of Example 3a. and 48 g unsaturated CPE resin emulsion (UCPE, 30 wt %) were added into a 2 L glass reactor equipped with an overhead stirrer and heating mantle. 35.84 g of $Al_2(SO_4)_3$ solution (1 wt %) was added as a flocculent under homogenization. The mixture was subsequently heated to 43.1° C. for aggregation at 300 rpm. The particle size was monitored with a Coulter Counter until the core particles reached a volume average particle size of 4.68 μm with a GSD of 1.23. Then, 145.14 g of the above resin and a absorber emulsion was added as a shell, resulting in a core-shell structured particles with an average particle size of 5.96 μm and a GSD of 1.25. Thereafter, the particle growth was frozen by increasing the pH of the reaction slurry was then increased to 6.89 using 1.39 g EDTA (39 wt %) and NaOH (4 wt %). After freezing particle growth, the reaction mixture was heated to 74.2° C., and the pH was reduced to 5.9 for coalescence. After coalescence, the toner was quenched, cooled to room temperature, separated by sieving (25 μm), washed, and freeze dried. The final toner particles had a final particle size of 6.41 μm, a GSD of 1.27, and a circularity of 0.981.

RESULTS

The toner particles of Comparative Example 1 and Examples 1-3 are summarized in Table 1 (below).

TABLE 1

| Example | IR Absorber | Particle Size (μm) | GSD | Circularity |
|---|---|---|---|---|
| 1 | NK-2911 | 5.77 | 1.24 | 0.983 |
| 2 | NK-4680 | 5.60 | 1.23 | 0.970 |
| 3 | S-0813 | 6.41 | 1.27 | 0.981 |
| Comp. 1 | — | 6.28 | 1.23 | 0.982 |

Surprisingly, the incorporation of cyanine dye improved toner heat cohesion from 48° C. to as high as 56° C. without having a negative affect on charging and cohesion. These results are summarized in Table 2 (below).

TABLE 2

| | | q/d (mm) −4 mm to −11 mm | | q/m (uC/g) | | Cohesion (Flow) | Blocking (Heat Cohesion) at 50% RH <10 | | | | | | | | | | |
|---|---|---|---|---|---|---|---|---|---|---|---|---|---|---|---|---|---|
| Example | Cyanine dye | AZ | CZ | AZ | CZ | <10 | 47 | 48 | 49 | 50 | 51 | 52 | 53 | 54 | 55 | 56 | Onset Temp (° C.) |
| 1 | NK-2911 | −5 | −12 | 28 | 42 | 11 | | | | 4 | 13 | 24 | | | | | 51 |
| 2 | NK-4680 | −5 | −11 | 26 | 43 | 7 | | | | 5 | 4 | 36 | | | | | 52 |
| 3 | S-0813 | −4 | −8.5 | 20 | 33 | 9 | | | | | | 3 | 2 | 5 | 6 | 48 | 56 |
| Comp. 1 | — | −7 | −13 | 25 | 37 | 8 | 9 | 25 | | 86 | | | | | | | 48 |

All toner samples were fused with a non-contact heating test fixture with a Heraerus IR emitter. Gloss results of fused toners are summarized in Table 3 (below). Examples 1-3, when compared with Comparative Example 1, have a desirable higher gloss.

TABLE 3

| | Example 1 | Example 2 | Example 3 | Comp. Example 1 |
|---|---|---|---|---|
| Gloss @ ~88 mm/s | 57 | 56 | 69 | 55 |
| Gloss @ ~120 mm/s | 24 | 28 | 29 | 19 |
| Gloss @ ~158 mm/s | 8 | 8 | 6 | 10 |

Minimum Fusing Temperature (MFT) was not measured because it is believed that with incorporating as small amount as 0.2 wt % cynine dye in toner, will not affect toner MFT.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. Toner particles, comprising a core and a shell, the core comprising an amorphous polyester resin, a crystalline polyester resin, and a cyanine dye, wherein the cyanine dye is selected from the group consisting of

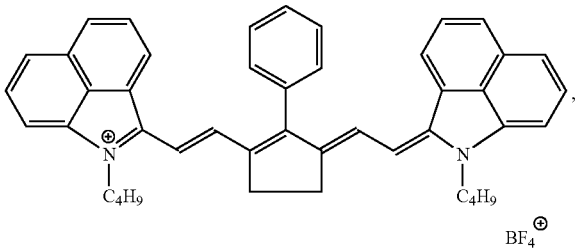

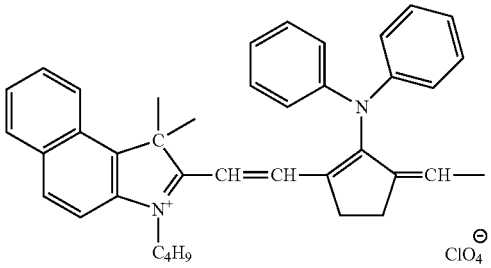

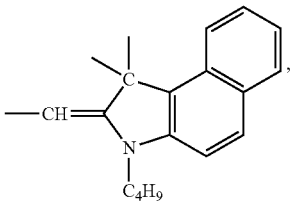

and

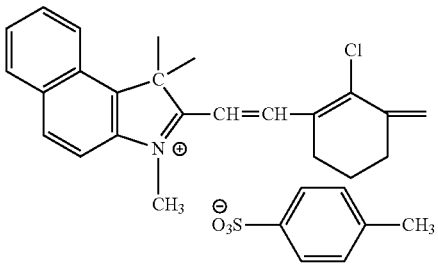

-continued

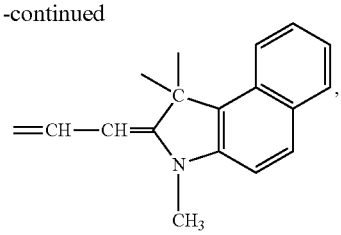

and wherein the shell comprises a same amorphous polyester resin as the core and a same cyanine dye as the core.

2. The toner particles of claim 1, wherein the cyanine dye comprises about 0.01 to about 5 wt % of the toner particles.

3. The toner particles of claim 1, wherein the cyanine dye is

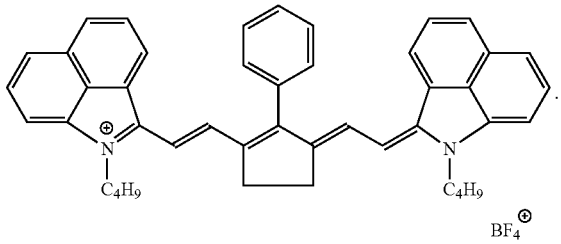

4. The toner particles of claim 1, wherein the toner particles have a GSD of less than or equal to about 1.30.

5. The toner particles of claim 1, wherein the toner particles have an average particle size of from about 3.55 to about 9 um.

6. The toner particles of claim 1, wherein the toner particles possess a parent toner charge per mass ratio of from about −3 μC/g to about −60 μC/g.

7. The toner particles of claim 1, wherein the toner particles have an average particle circularity of from about 0.950 to about 0.980.

8. A method of making toner particles, the method comprising:

emulsifying an amorphous polyester resin, a crystalline polyester resin, a cyanine dye, an optional colorant, and an optional wax to form pre-aggregated particles, wherein the cyanine dye is selected from the group consisting of:

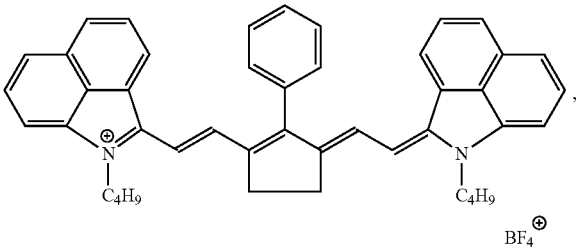

-continued

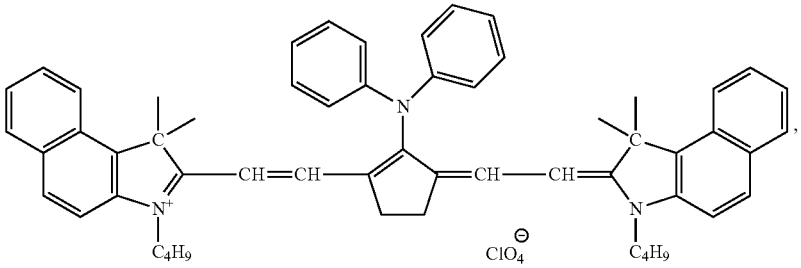

, and

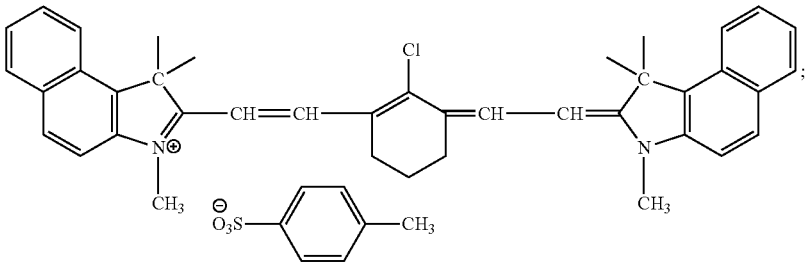

;

aggregating the pre-aggregated particles to form aggregated core particles;

forming a shell on the aggregated core particles, wherein the shell comprises a same amorphous polyester resin as the aggregated particles and a same cyanine dye as the aggregated particles;

coalescing the core-shell particles to form coalesced particles; and isolating the coalesced particles.

9. The method of claim 8, wherein the cyanine dye comprises about 0.01 to about 5 wt % of the toner particles.

* * * * *